US005964277A

United States Patent [19]

Tanaka et al.

[11] Patent Number: 5,964,277

[45] Date of Patent: Oct. 12, 1999

[54] TWIN DRUM TYPE CONTINUOUS CASTING METHOD

[75] Inventors: Kisaburo Tanaka; Keiichi Yamamoto; Youichi Wakiyama, all of Hiroshima, Japan

[73] Assignee: Mitsubishi Heavy Industries, Ltd., Tokyo, Japan

[21] Appl. No.: 09/035,772

[22] Filed: Mar. 6, 1998

[30] Foreign Application Priority Data

Mar. 18, 1997 [JP] Japan ..... 9-064451

[51] Int. Cl.[6] ..... B22D 11/06

[52] U.S. Cl. ..... 164/480; 164/121; 164/158

[58] Field of Search ..... 164/480, 479, 164/121, 158, 428, 429

[56] References Cited

U.S. PATENT DOCUMENTS 5,651,413 7/1997 Williams et al. ..... 164/480 X

FOREIGN PATENT DOCUMENTS

| | | |
|---|---|---|
| 60-184449 | 9/1985 | Japan . |
| 62-254953 | 11/1987 | Japan . |
| 64-83342 | 3/1989 | Japan . |
| 1-89842 | 6/1989 | Japan . |
| 5-7997 | 1/1993 | Japan . |
| 6-39501 | 2/1994 | Japan . |

OTHER PUBLICATIONS

Patent Abstracts of Japan, vol. 010, No. 025, No. 60–184449, published Sep. 19, 1985.

Patent Abstracts of Japan, vol. 012, No. 131, No. 62–254953, published Nov. 6, 1987.

Patent Abstracts of Japan, vol. 013, No. 289, No. 01–083342, published Mar. 29, 1989.

Patent Abstracts of Japan, vol. 018, No. 254, No. 06–039501, published Feb. 15, 1994.

Patent Abstracts of Japan, vol. 097, No. 008, No. 09–108786, published Apr. 28, 1997.

*Primary Examiner*—J. Reed Batten, Jr.

*Attorney, Agent, or Firm*—Wenderoth, Lind & Ponack, L.L.P.

[57] ABSTRACT

A molten metal is poured in a molten metal storage portion (50) formed between a pair of cooling drums (1, 1') which rotate in opposite directions to each other and a thin metal plate (40) is discharged downward thereof. A casting operation is performed while shot particles (30) are being blasted by a shot particles blasting device (15) from at least two positions onto an entire widthwise outer circumferential surface (2) of each cooling drum (1, 1') so as to form dimples on the circumferential surface (2), thereby preventing the occurrence of cracks in the cast piece (40). Also, a brushing device (5) is disposed in abutting relation on the outer circumferential surface (2) of the cooling drum (1, 1') in order to clean the surface (2).

8 Claims, 3 Drawing Sheets

TWIN DRUM TYPE CONTINUOUS CASTING METHOD

BACKGROUND OF THE INVENTION

1. Field of the Invention

The present invention relates to a twin drum type continuous casting method in which a pair of cooling drums, rotating in opposite directions to each other, form a molten metal storage portion therebetween and discharge a thin metal plate downward thereof.

2. Description of the Related Art

In a twin drum type thin plate continuous casting apparatus, a pair of cooling (casting) drums, which are cooled by cooling water circulating in an interior thereof, are supported horizontally by bearings fitted to a frame so as to be parallel to maintain a casting gap which corresponds to a cast piece thickness. Above the casting gap of the cooling drums, there is formed a molten metal storage portion to which a molten metal is supplied continuously from a tundish via a nozzle.

The molten metal in the molten metal storage portion comes in contact with a surface of the cooling drums and is cooled to form a solidified shell, which in turn is led by the pair of cooling drums, which are driven to rotate in opposite directions to each other, to be discharged from the casting gap of the cooling drums as a cooled and solidified thin strip cast piece.

In the twin drum type continuous casting method for casting a cast piece as mentioned above, in order to obtain a cast piece having no defects such as surface cracks (fine cracks) etc. and having an excellent characteristics and quality, there are effectively used a shot blasting method, a photo-etching method, an electric discharge machining method, an electron beam machining method, etc., which are applied to a cylindrical surface of the cooling drum of the continuous casting apparatus so as to form a multiplicity of minute dimples uniformly or at random thereon, each said dimple having a shape of circle, oval, etc. of depth of approximately 5 to 100 $\mu$m and diameter of approximately 0.1 to 1.2 mm. This is known from publications of the Japanese laid open patent application Nos. Sho 60(1985)-184449, Sho 62(1987)-254953, Sho 64(1989)-83342, etc.

Also, in the Japanese laid open patent application No. Hei 6(1994)-39501, as shown in FIG. 5, there is disclosed a twin drum type thin plate continuous casting apparatus comprising a detecting device 113, 114 for detecting a surface temperature of a cast piece by sweeping thereon in the widthwise direction, a control device 112 to which a detected value of the cast piece surface temperature detecting device 113, 114 is inputted and a shot blasting device 115, 116 which, receiving a control signal from the control device 112, moves in the axial direction of the cooling drum 1, 1' to apply a shot blasting onto a surface of the cooling drum 1, 1'. Meanwhile, in FIG. 5, numeral 110, 111 designates a brush for cleaning the drum.

In the prior art twin drum type continuous casting apparatus as shown in FIG. 5, temperature of the cast piece 40 is detected so that an area where the temperature is lower than a permissible temperature is detected and the control device 112 moves a nozzle of the shot blasting device 115, 116 to a position on the cylindrical surface of the cooling drum which corresponds to said area and causes a shot blasting to operation start. Also, it is so described there that even if there occur dimple worn-out places irregularly here and there, the control device 112 aims at such places and applies the shot blasting easily.

However, if such a cooling drum as having a sufficient cooling effect of the drum surface is employed, the surface dimples wear substantially uniformly as a whole and there occur surface temperature lowered portions everywhere until it comes to a time to detect such a partial temperature lowering in the cast piece as mentioned above, so that there is a problem in that a good response cannot be attained by detection of the respective temperature lowered portions and control of the nozzle movement to the position to be shot-blasted.

SUMMARY OF THE INVENTION

In view of the problems in the prior art twin drum type continuous casting method and apparatus as aforementioned, it is an object of the present invention to provide a twin drum type continuous casting method in which dimples can be formed on a cooling drum surface so as to prevent in occurrence of cracks in a thin metal plate which is being cast, and thus there is no need of detecting temperature distribution of a cast piece surface nor of controlling shot particles blasting position to the cooling drum surface.

According to the present invention, in order to attain the above object, in a twin drum type continuous casting method employing a drum device having a sufficient cooling effect of the drum surface, an area ratio of dimples formed by shot particles on the outer circumferential surface of the cooling drum is made smaller and blasting is done uniformly, thus the dimples formed previously can be repaired without a sudden change in the shape and area ratio of the dimples.

That is, in order to solve the problem in the prior art, the present invention provides a twin drum type continuous casting method in which a molten metal is poured in a molten metal storage portion formed between a pair of cooling drums rotating in opposite directions to each other and a thin metal plate is discharged downward thereof, characterized in that casting is performed while shot particles are being blasted continuously from at least two positions onto an entire widthwise surface of each cooling drum.

In the twin drum type continuous casting method according to the present invention, the shot particles are blasted preferably in a blasting density of 0.05 to 10%. That is, in the twin drum type continuous casting method according to the present invention, dimples (concave portions) are formed in advance on the outer circumferential surface of the cooling drum and the shot particles are blasted in the blasting density of 0.05%, thereby making-up of the initial dimples becomes possible and there has been caused no crack in the cast piece even after a casting of 200 minutes. Also, in the case where the blasting density of the shot particles is set to 10%, even with continuous blasting, there is caused only a small amount of wear of the outer circumferential surface of the cooling drum.

In the above, the blasting density means a ratio of the area of the dimple (concave) portions formed on the outer circumferential surface of the cooling drum when one path is blasted, that is, one rotation of the cooling drum in case the casting is done while a continuous blasting is being applied to the outer circumference surface of the rotating cooling drum, is finished, to the area of the cooling drum surface and is expressed by the following equation (1);

(Equation 1) (1)

$$\text{Blasting density}(\%) = \frac{\text{Area of the dimple portions formed on the drum surface}}{\text{Area of the surface of the cooling drum}} \times 100$$

If the blasting density is less than 0.05%, a new dimple making-up or forming rate cannot catch up relative to the wearing rate with the result that the effect of the dimples is gradually reduced and the continuous casting time becomes shortened and cracks occur in the cast piece.

On the other hand, if the blasting density is set to more than 10% from the beginning, there occurs an extraordinarily large difference in the blasting densities at adjacent places resulting in a problem of cracks occurring in the cast piece. As described later, however, if the blasting density is increased gradually, there arises no such problem as mentioned above and the blasting density may be raised to more than 10%.

As a device that is able to change the blasting density of the shot particles largely from thin to thick, a shot particles blasting device of a centrifugal type has been effective. Control of the blasting density can be achieved by increasing or decreasing a rotational speed of a screw type feeding device of a shot particles feeding portion containing a centrifugal impeller. Otherwise a pneumatic pressure type blasting device is also effective as it is able to provide a similar mechanism. In order to effect blasting over the entire width, the device may be oscillated.

In the twin drum type continuous casting method of the present invention as aforementioned, the shot particles are blasted preferably with a deviation in the rotational direction of the cooling drum so as not to interfere with each other.

As mentioned above, the shot particles are blasted with a deviation in the rotational direction as to the blasting direction so as not to interfere with each other, the blasting rate is restricted so that the maximum blasting density at the central portion becomes 10% or less and the position of the shot device is regulated so that the blasting density at the drum end portion and the drum central portion becomes ⅓ or more of the maximum density, thus as shown in FIG. 4, the blasting is done such that distribution of the shot particle dispersion becomes uniform over the entire widthwise surface.

Also, the present invention provides a twin drum type continuous casting method in which a molten metal is poured in a molten metal storage portion formed between a pair of cooling drums rotating in opposite directions to each other and a thin metal plate is discharged downward thereof, characterized in that a casting is performed while shot particles are being blasted intermittently from at least two positions onto an entire widthwise surface of each cooling drum.

In case the shot particles are blasted intermittently as mentioned above, the blasting may be performed as follows. That is, the casting is started with the cooling drum on which dimples are formed in advance and the blasting is started within 60 minutes from the start of casting. At the beginning of the blasting of the shot particles, the blasting density is set to 0.05 to 0.5%, and the blasting is done for several rotations or several tens of rotations wherein the blasting density is set to maximum 5 to 10%. Then, the blasting density is reduced gradually to 0.05 to 0.5% and the blasting is stopped. By so doing, the density distribution of the dimples on the outer circumferential surface of the cooling drum can be prevented from being changed suddenly and casting can be performed continuously with no interruption of the casting operation.

Further, in case a repair of dimples is performed with an increased density of the shot particles, the repair is started with the blasting density of 5 to 10% within 60 minutes from the start of the casting, continued in a further increased blasting density and, upon completion of the repair, stopped with the same condition as that at the time of the start. As for the repairing cycle for a second and a subsequent time, the starting time is determined by the following equation (2) by use of the previous blasting condition;

(Equation 2)

$$\text{Pause period T (min)} \leq 2.3 \times \log\{1 + \Sigma(\text{Blasting density}(\%) \times \text{Rotation number}/100)\} \times 100 - 40 \quad (2)$$

Provided that the pause period, being a period in which wearing of the dimples occurs, is set to a maximum of 60 minutes. That is, if the blasting is continued with a certain blasting density so that the dimples are overlapped one on another additionally, there occurs a waste shot in which a new dimple is formed on a previously formed one and a cumulative dimple density can be approximated by the following equation (3);

(Equation 3) (3)

$$\text{Cumulative dimple density}(\%) = 2.3 \times \log\{1 + \Sigma \times (\text{Blasting density}(\%) \times \text{Rotation number}/100)\} \times 100$$

If the dimples are to be formed by one time of the cumulative dimple density, as shown by the above Equation 3, prevention of cracks will be possible with the cumulative dimple density of 30%, however, the repairing effect is lost quickly. Thus, with the cumulative dimple density of 40% or more, there arises firstly a surplus in the repairing effect and thus pause of the blasting for repair becomes possible.

DETAILED DESCRIPTION OF THE INVENTION

Embodiments according to a twin drum type continuous casting method of the present invention are described below with reference to FIGS. 1 to 4.

(First Embodiment)

Figure 1:
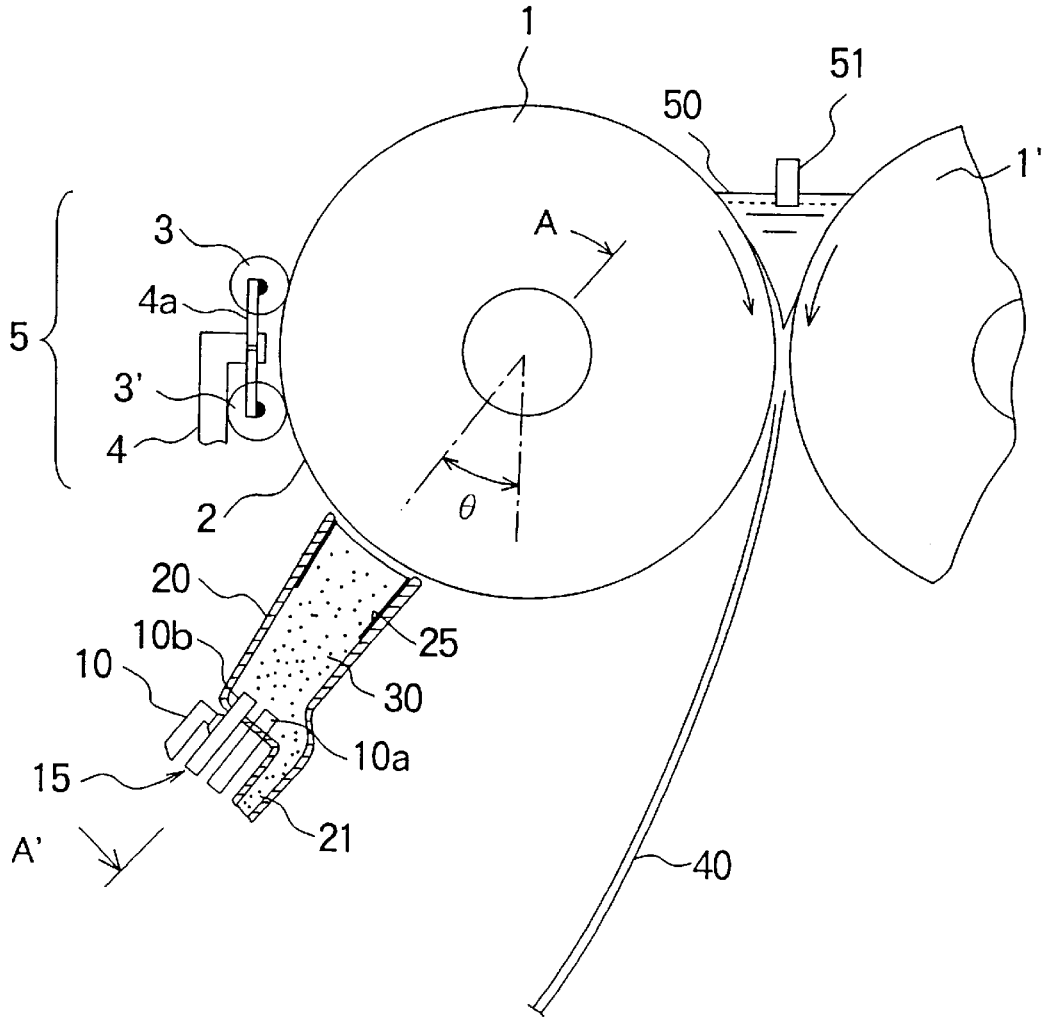
FIG. 1 is a cross sectional view of an apparatus used for a twin drum type continuous casting method according to a first embodiment of the present invention.
Figure 2:
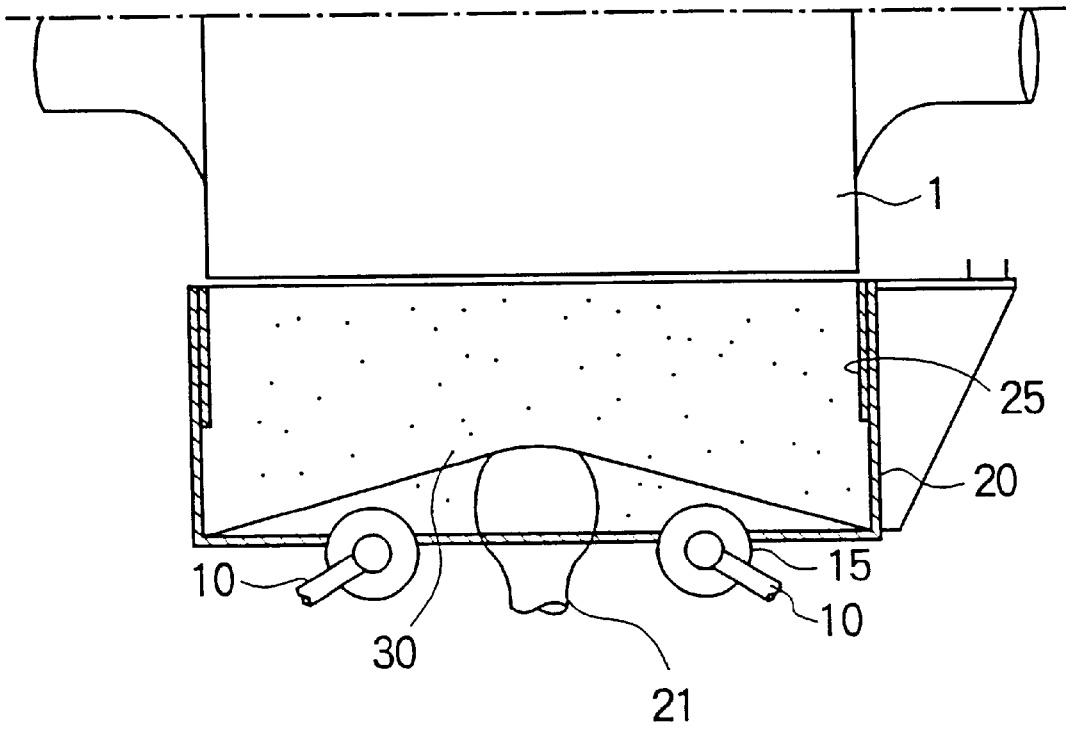
FIG. 2 is a cross sectional view taken along line A–A' of FIG. 1.
Figure 3:
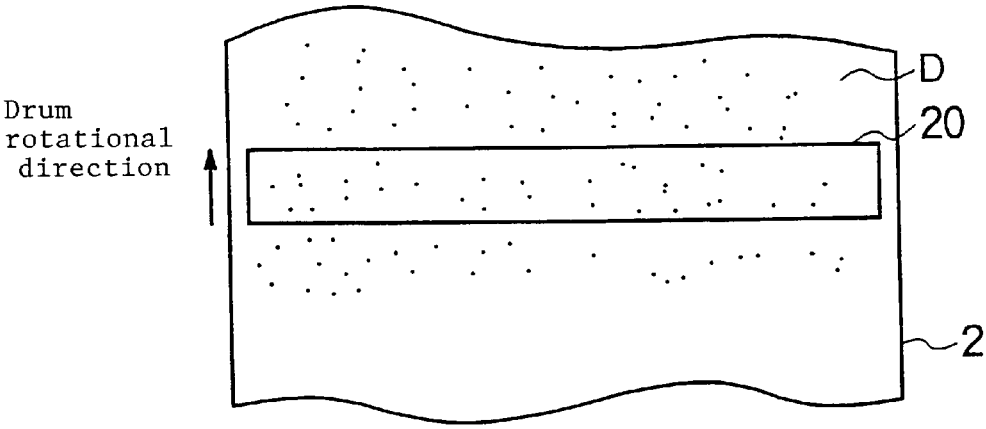
FIG. 3 is an explanatory view showing a state where dimples are formed by shot particles according to the first embodiment of the present invention.
Figure 4:
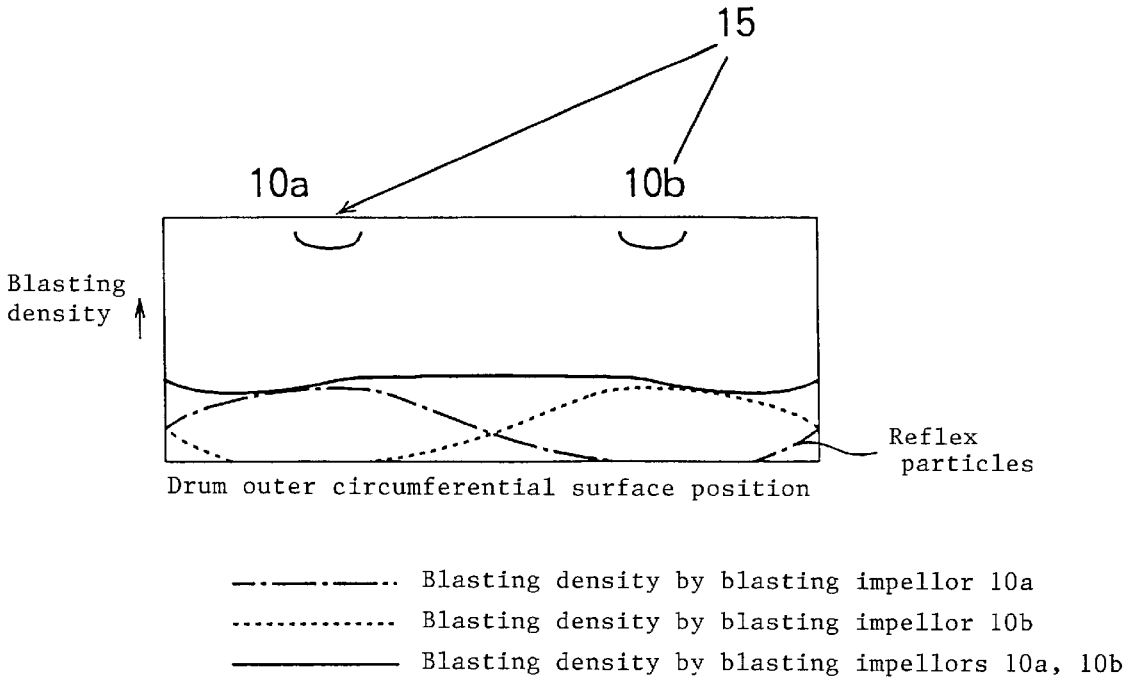
FIG. 4 is an explanatory view showing a state of distribution of shot particle dispersion in the twin drum type continuous casting method of the present invention.
Figure 5:
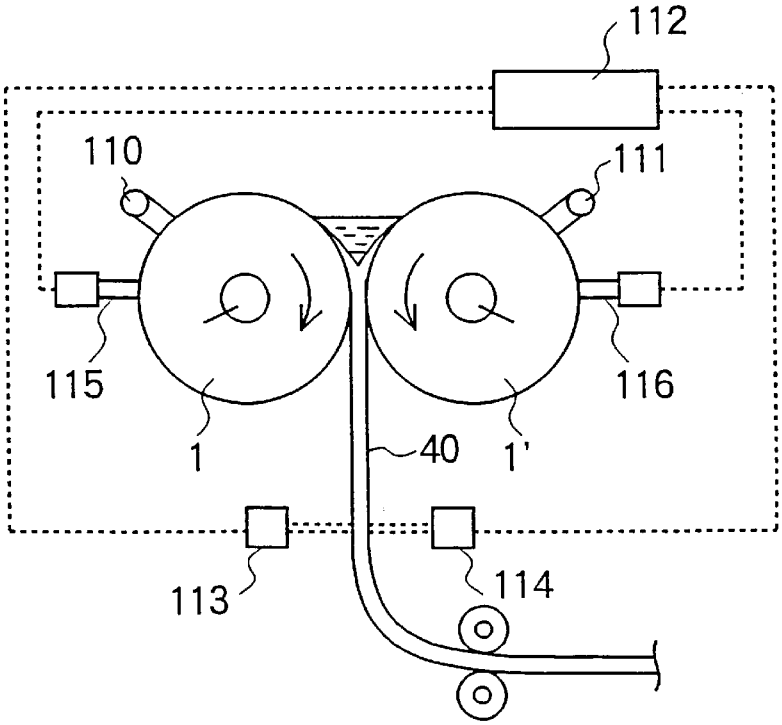
Fig. 5 (Prior Art)
FIG. 5 is an explanatory view of a prior art twin drum type continuous casting apparatus.

A first embodiment is described with reference to FIGS. 1 to 3. In FIGS. 1 to 3, numerals 1, 1' designate water-cooled cooling drums which are arranged so to oppose each other.

Each of the drums has a cooling water passage therein and is constructed so as to have a diameter of 1200 mm and a width of 800 mm. One of the drums 1' is a movable drum which is movable relative to the other drum 1 in the direction to connect the axes of both drums 1, 1'. Both cooling drums 1, 1' rotate around their respective axis in opposite directions to each other as shown by arrows in FIG. 1.

Between the cooling drums 1, 1' is a molten metal storage portion 50 to which a molten metal is supplied from a molten metal pouring nozzle 51, and the construction is such that the molten metal is continuously solidified to form a cast piece of thin metal plate and to be discharged downwardly from the molten metal storage portion 50.

On an outer circumferential surface 2 of the cooling drum 1, 1', there are formed in advance a multiplicity of initial dimples D (FIG. 3) by a photo-etching method. Each dimple has a diameter of 0.3 to 0.6 mm and a depth of 0.05 to 0.15 mm, so as to form an area ratio of the dimples D of 30%. That is, with an area of the dimples D of less than 30%, there are caused cracks in the cast piece and with an area of 30% or more, the casting becomes possible without causing cracks in the cast piece and even with that of 100%, there is seen no crack.

On an upstream side in the rotational direction of the cooling drum 1, 1', there is provided a shot particles blasting device 15. In FIG. 1, a shot particles blasting device of only one cooling drum 1 is shown, and illustration of the other cooling drum 1' is omitted. The shot particles blasting device 15 is arranged perpendicularly to the outer circumferential surface 2 of the cooling drums 1, 1' in an inclined upward direction, an angle θ of inclination thereof being 30° relative to the rotational direction of the cooling drum 1, 1' from right beneath the cooling drum 1, 1'. The shot particles blasting device 15 comprises a shot particles supply conduit 10 which has a blasting impeller 10*a*, 10*b* at its terminal end portion.

The shot particles blasting device 15 is arranged with two units spaced relative to each other in an axial direction of the cooling drums 1, 1', as shown in FIG. 2. In a space between the shot particles blasting device 15 and the cooling drum 1, 1', there is provided a cover 20 for covering a part of the circumferential surface of the cooling drum 1, 1' along substantially the entire length in the axial direction, or substantially the entire width, of the cooling drum 1, 1', as shown in FIG. 3. The shot particles blasting device 15 is of a centrifugal type.

The two units of the shot particles blasting device 15 are disposed with a deviation between each other in the rotational direction of the cooling drum 1, 1' and the amount of this deviation will be sufficient if it is same as a height of the impeller of the shot particles blasting device 15. The maximum amount of the deviation becomes 314 mm between a front end and a rear end of the fitting positions of the shot particles blasting devices 15, when a diameter of the cooling drum is 1.2 m.

A lining of a wear resistant material 25 is applied to an inner side of the cover 20. A gap between the cover 20 and the cooling drum 1, 1' is set to approximately 1 to 2 mm, and each end of the cover 20 is positioned 1 to 5 mm inside of each end of the cooling drum. Also, at a lower portion of the cover 20, there is provided a shot particles recovery nozzle 21 of an air suction type. The cover 20 is connected to a bearing portion (not shown) of the cooling drum 1 so that there is caused no relative displacement relative to the cooling drum 1, 1'.

On a downstream side of the shot particles blasting device 15 in the rotational direction of the cooling drum 1 and on an opposite side to the side where the two cooling drums 1, 1' are opposing to each other, there is provided a brushing device 5. In FIG. 1, the brushing device 5 of one cooling drum 1 only is shown, with the illustration of the other cooling drum 1' being omitted.

The brushing device 5 comprises a supporting member 4 connected to a bearing portion (not shown) of the cooling drum 1 a supporting arm 4*a* connected pivotably at its central portion to an end portion of the supporting member 4 and a brushing wheel 3, 3' fitted by a bearing to each end portion of the supporting arm 4*a* so as to abut on the outer circumferential surface 2 of the cooling drum 1.

In the first embodiment constructed as mentioned above, shot particles 30 are blasted toward the outer circumferential surface 2 of the cooling drum 1 from the shot particles blasting device 15, thereby dimples D are formed on the outer circumferential surface 2 of the cooling drum 1. These dimples D, together with initial dimples D formed in advance on the outer circumferential surface 2 of the cooling drum 1, 1', serve to prevent occurrence of cracks in the cast piece 40 which is solidified at the molten metal storage portion 50 and is discharged.

Moreover, as the dimples D are continuously formed on the outer circumferential surface 2 of the cooling drum 1, 1' while the cooling drum 1, 1' rotates for casting, even if there occur changes in the configurations of the initial dimples D, occurrence of cracks in the cast piece 40 can be prevented. Thus, according to the first embodiment, a continuous casting for hours can be performed and a continuous casting amount per time can be increased.

Also, as the shot particles blasting device 15 is of a centrifugal type and the cover 20 covers the cooling drum 1 along the substantially entire length in the axial direction or the substantially entire width thereof, the shot particles 30 collide with an entire area of the outer circumferential surface 2 of the cooling drum 1, thereby the dimples D can be formed uniformly over the entire area of the outer circumferential surface 2 of the cooling drum 1.

The shot particles 30 blasted by the shot particles blasting device 15 collide with the outer circumferential surface 20 of the cooling drum 1 are accumulated in the lower portion within the cover 20 and then are sucked by the shot particles recovery nozzle 21 so as to be recovered.

The shot particles which have not been recovered by the shot particles recovery nozzle 21 may attach to an oxide film formed on the outer circumferential surface 2 of the cooling drum 1, 1' by the casting operation, and the particles attached to the outer circumferential surface 2 of the cooling drum 1, 1' by the blasting of the shot particles 30, etc. follow the rotation of the cooling drum 1, 1' until they come to the brushing device 5, where they are removed from the outer circumferential surface 2 of the cooling drum 1, 1' by the brushing wheel 3, 3'. Thus, there is caused no mixing of the attached particles will not mix with the molten metal in the molten metal storage portion 50 and occurrence of cracks in the cast piece 40 can be prevented.

Also, according to the first embodiment, the amount of the shot particles 30 supplied into the shot particles blasting device 15 can be arbitrarily changed, for example, by changing a rotation of a screw feeder, and thereby a blasting density of the shot particles can be regulated easily so as to change the area ratio of the dimples D and the blasting density of the shot particles also can be regulated corresponding to a casting speed.

In the first embodiment, the casting has been performed with a casting speed of 60 m/min and a blasting rate of 250 g/min using the shot particles 30 of average particle diameter of 0.8 mm. No cracks in the cast piece 40 occurred even with a lapse of 180 minutes after beginning of the casting and an excellent result could be obtained. The area ratio of the dimples D formed by the blasting of the shot particles 30 at this time was 0.05%.

Also, in the first embodiment, even in the case where the blasting rate of the shot particles 30 has been changed from 250 g/min to 50 kg/min with other conditions being unchanged, no cracks occurred in the cast piece 40 after 180 minutes from the beginning of the casting and an excellent result has been obtained. The area ratio of the dimples D formed by the blasting of the shot particles 30 at this time was 10%.

Also, in the first embodiment, the blasting of the shot particles 30 has been started with a blasting rate of 250 g/min after 60 minutes from beginning of the casting, and the blasting rate has been increased with an increasing rate of 250 g/sec until coming to a final blasting rate of 50 kg/min. The blasting at this final blasting rate was applied for 17 rotations of the cooling drum 1, 1', then the blasting rate was decreased with a decreasing rate of 250 g/sec until coming to a blasting rate of 2500 g/min, at which the blasting was stopped.

While casting is being continuously performed, the blasting was started again 60 minutes thereafter with a blasting rate of the shot particles 30 of 2500 g/min. The blasting rate was increased up to a maximum 70 kg/min and then decreased to 2500 g/min, at which the blasting was stopped. The casting has been performed with the operation being repeated three times and an excellent cast piece was been obtained. Even when blasting was started with a blasting rate of the shot particles 30 of 50 kg/min or even when the blasting rate immediately before the stop of the blasting was set to 50 kg/min, the same excellent result was obtained.

(Second Embodiment)

Next, a second embodiment is described below. While the second embodiment has the same construction as in the first embodiment as described above, the cooling drums 1, 1' are not initially formed with the dimples D by the photo etching method, but are formed initially with dimples D of an area ratio of 30% by the shot particles 30 by the shot particles blasting device 15.

The dimples D, formed by the shot particles 30 blasted by the shot particles blasting device 15 during the casting, have been formed in the same way as in the first embodiment. And in the second embodiment also, the same function and effect as in the first embodiment has been obtained.

It is to be noted that while the cooling drums 1, 1' having initial dimples D on the outer circumferential surface are used in the first and second embodiments, a cooling drum having no initial dimples D but having only the dimples formed on the outer circumferential surface by the shot particles blasted by the shot particles blasting device during the casting may be used in the present invention.

In the second embodiment, casting has been done with a casting speed of 60 m/min and a blasting rate of 50 kg/min using the shot particles 30 of average particle diameter of 0.8 mm, and even with a lapse of 180 minutes after beginning of the casting, no cracks occurred in the cast piece 40 and an excellent result could be obtained. The area ratio of the dimples D formed by the blasting of the shot particles 30 at this time was 10%.

Also, in second embodiment, the casting has been performed on the same drum condition and casting speed as in the first embodiment. The blasting was performed with a blasting rate of 50 kg/min using the shot particles 30 of average particle diameter of 1.0 mm and because of the brushing wheels 3, 3' provided downstream thereof, oxide etc. stuck to the cooling drum outer circumferential surface have been removed so that occurrence of cracks in the thin metal plate can be prevented sufficiently and an effect of increased cast piece production from the molten metal has been obtained.

In the above, the present invention has been described based on the embodiments as illustrated but, needless to mention, the present invention is not limited to said embodiments but may include various modifications in the construction and structure within the scope of the claims as mentioned below.

For example, while a centrifugal type of the shot particles blasting device has been used in the embodiments, a pneumatic pressure type blasting device may be used instead.

Also, an angle of 30° as the inclination angle θ of the shot particles blasting device 15 relative to the rotational direction of the cooling drum 1, 1' from right beneath the cooling drum 1, 1' has been employed in the embodiments, said angle θ is appropriate if it is 15 to 50° so as not to interfere with drawing of the cast piece and with the brushing. Incidentally, if the angle θ is less than 15°, there occurs a problem of making contact with the drawn cast piece and if it is more than 50°, recovery of the shot particles will become difficult because of the blasted shot particles falling down through a gap between the drum and the nozzle.

According to the twin drum type continuous casting method of the present invention as aforementioned, the casting is done while the shot particles are being blasted from at least two positions continuously or intermittently onto the substantially entire widthwise surface of the cooling drum, thereby without a need to control the positions of the shot particles blasting device by detecting the temperature distribution in the cast piece which is being cast as in the prior art, dimples can be formed in a low density and in a uniform distribution on the outer circumferential surface of the cooling drum by the shot particles blasting device while the casting is being done. Accordingly, by use of the twin drum type continuous casting method of the present invention, occurrence of cracks in the thin metal plate which is being cast can be prevented and the casting amount per time can be increased.

What is claimed is:

1. A twin drum type continuous casting method comprising:

supplying a molten metal in a molten metal storage portion formed between a first cooling drum and a second cooling drum;

rotating said first and second cooling drums in opposite directions to each other such that a thin metal plate is discharged downward from between said first and second cooling drums;

continuously blasting an entire width of an outer peripheral surface of said first cooling drum with shot particles from at least two positions, wherein the shot particles are blasted in a blasting density of 0.05 to 10%; and continuously blasting an entire width of an outer peripheral surface of said second cooling drum with shot particles from at least two positions, wherein the shot particles are blasted in a blasting density of 0.05 to 10%.

2. A twin drum type continuous casting method as claimed in claim 1, further comprising:

spacing said two particle blasting positions in a rotational direction of said first cooling drum so that said shot particles from said two shot particle blasting positions on said first cooling drum do not interfere with each other; and spacing said two particle blasting positions in a rotational direction of said second cooling drum so that said shot particles from said two shot particle blasting positions on said second cooling drum do not interfere with each other.

3. A twin drum type continuous casting method as claimed in claim 1, further comprising:

providing a brushing device on said first cooling drum at a downstream side of the shot particles blasting positions on said first cooling drum relative to the rotational direction of said first cooling drum; and providing a brushing device on said second cooling drum at a downstream side of the shot particles blasting positions on said second cooling drum relative to the rotational direction of said second cooling drum.

4. A method of casting a thin metal plate, said method comprising:

pouring a molten metal into a molten metal storage portion formed between a first cooling drum and a second cooling drum;

rotating said first and second cooling drums in opposite directions to each other such that a thin metal plate is discharged downwardly from said first and second cooling drums;

intermittently blasting the outer peripheral surface of said first cooling drum over an entire width thereof, wherein said first cooling drum is blasted from at least two positions with shot particles which are blasted in a blasting density of 0.05 to 10%; and intermittently blasting the outer peripheral surface of said second cooling drum over an entire width thereof, wherein said first cooling drum is blasted from at least two positions with shot particles which are blasted in a blasting density of 0.05 to 10%.

5. A method of casting a thin metal plate as claimed in claim 4, further comprising calculating a pause period T, when said shot particles are blasted intermittently onto the surface of said first and second cooling drums is set to a value of 60 minutes or less, is calculated by the following equation:

$$T(\text{min}) \leq 2.3 \log \{1+\Sigma(\text{Blasting density}(\%)\times\text{Rotation number})/100\}\times 100-40.$$

6. A method of casting a thin metal plate as claimed in claim 4, wherein said blasting operation is performed with a pattern of repeated cycles, wherein one cycle includes:

blasting at a blasting density of 0.05% at an initial stage of blasting;

blasting at a blasting density of at least 10% at a maximum time of blasting;

blasting at a blasting density of 0.05 to 10% at a final stage of blasting; and pausing the blasting process for a pause period of time T.

7. A method of casting a thin metal plate as claimed in claim 6, blasting said shot particles such that a cumulative blasting density in one cycle is at least 40%.

8. A method of casting a thin metal plate as claimed in claim 4, further comprising:

providing a first brushing device on said first cooling drum at a downstream side of the shot particles blasting positions thereof relative to the rotational direction of said first cooling drum; and providing a second brushing device at said second cooling drum at a downstream side of the shot particles blasting positions thereof relative to the rotational direction of said second cooling drum.

* * * * *